United States Patent [19]

Braun et al.

[11] 4,269,304

[45] May 26, 1981

[54] SCRAPER CHAIN CONVEYOR ASSEMBLY

[75] Inventors: Ernst Braun; Gert Braun, both of Essen-Heisingen, Fed. Rep. of Germany

[73] Assignee: Halbach & Braun, Fed. Rep. of Germany

[21] Appl. No.: 1,694

[22] Filed: Jan. 8, 1979

[30] Foreign Application Priority Data

Jul. 1, 1978 [DE] Fed. Rep. of Germany ..... 2829011

[51] Int. Cl.[3] ..... G65G 19/18

[52] U.S. Cl. ..... 198/735; 198/725; 299/43

[58] Field of Search ..... 198/735, 583, 584, 860, 198/861, 725; 299/43, 34; 104/165; 105/29 R

[56] References Cited

FOREIGN PATENT DOCUMENTS 279844 6/1962 Netherlands ..... 299/34

895784 5/1962 United Kingdom ..... 299/43

*Primary Examiner*—Robert B. Reeves

*Assistant Examiner*—Douglas D. Watts

*Attorney, Agent, or Firm*—McGlew and Tuttle

[57] ABSTRACT

A scraper chain conveyor assembly comprises a plurality of trough sections arranged in end-to-end relationship and a bracket side section extending along each trough section. Each bracket side section includes a hollowed sectional part and a mining machine embraces the sectional part and has a sprocket wheel which engages through an elongated slot defined in the sectional part. A round link chain extends through the hollowed sectional part and has respective crossing links held by the sectional part in link-crossing orientation so that one of the crossing links is oriented for engagement by the sprocket wheel engaging through the slot. A round link chain is subdivided without any separation of the chain links from each other into chain strand sections which are equal in length to the length of the individual trough sections and these chain strand sections are associated with the trough sections in a manner such that they leave a predetermined clearance of motion for the chain strand in the longitudinal direction thereof. Preferably, oblong slots are defined so as to extend transversely through the hollowed sections and crossbolts are arranged in the oblong slots so that they have a clearance of motion which equals the clearance of motion predetermined for the chain strand sections. Each strand section is preferably equipped with at least two crossbolts spaced along its length.

5 Claims, 3 Drawing Figures

SCRAPER CHAIN CONVEYOR ASSEMBLY

FIELD AND BACKGROUND OF THE INVENTION

This invention relates in general to the construction of conveyors and, in particular, to a new and useful scraper chain conveyor assembly, particularly with a single chain, which includes trough sections and a bracket-shape side section having hollowed sectional parts through which the chain runs so that it may be engaged by a sprocket of a mining machine embracing the hollowed profile parts.

DESCRIPTION OF THE PRIOR ART

A known scraper chain conveyor comprises a pulling chain guide in which the hollowed sectional part for guiding the drive chain is made of angle sheets which are screwed to the associated side wall of the conveyor trough. The driving chain is a sideplate chain, which is disadvantageous when used in many directions. As is also known, a sideplate chain only comprises horizontal links and the sideplates are articulated with each other by pins. Such a chain is only flexible in one plane, that is, with a horizontal arrangement, in the vertical plane.

With a cutter pulling chain guide, a horizontal arrangement is necessary to enable the sprocket wheel to engage the slot of the hollowed sectional part from above, through the chain. This mobility, reduced to the vertical plane, is unsatisfactory in a scraper chain conveyor. That is, as a rule, a scraper chain conveyor does not only follow synclines and anticlines, but it also frequently follows curves. However, in a curved extension, breaks in the horizontal plane between the individual trough sections are inevitable. For the reasons mentioned above, a sideplate chain cannot follow such breaks. In addition, breaks in the horizontal plane occur between the trough section, in principle, also during the shifting of the scraper chain conveyor. Care must be taken continually to enable the driving chain to follow the curved and partly broken extension of the conveyor. In practice, this is impossible with a sideplate chain. Consequently, a satisfactory engagement of the sprocket wheel of the mining machine is not ensured, at least not with a curved run of the scraper chain conveyor.

In order to avoid these drawbacks, a design has been provided in which the driving chain is a round-link chain with horizontal links having a very small vertical and horizontal clearance of motion and with vertical links having a large vertical and horizontal clearance of motion in the hollowed section in which they are guided. This makes the driving chain flexible to such an extent that it can adapt in both the horizontal plane and in the vertical plane to the scraper chain conveyor or the hollowed section intended for guiding the chain. That is, the flexibility of a round-link chain remains preserved even if the horizontal chain links are guided with a minimum clearance of motion while the clearance of motion of the vertical links, in practice, remains unrestricted.

In fact, a vertical and a horizontal axis of articulation is thereby obtained between each horizontal and vertical chain link. It is therefore absolutely irrelevant in which transition zones between trough sections the line of the scraper chain conveyor breaks while following a curve or during the shifting. The round-link chain as a driving chain can always adapt to such a break, due to its vertical and horizontal articulation at that specific location. However, problems still arise if the chain links of the round-link chain become pulled apart at one end of the hollowed section andd pushed together at the other end of that section.

This may happen, for example, if the scraper chain conveyor is run in a steep or moderately steep formation and the chain links slip because their self-locking is overcome by the slope. However, a pulling apart or pushing together of the chain links may also be due to other causes. On the other hand, an engagement true to pitch between the sprocket wheel and the round-link chain is then no longer ensured and, on the other hand, an angled arrangement between the trough sections is hardly possible, or possible only within small limits, at least in the zone of chain links pulled apart. This situation is remedied by the invention.

SUMMARY OF THE INVENTION

The present invention is directed to a scraper chain conveyor, particularly a single chain conveyor, in which the round-link chain is positioned in the hollowed sectional part serving as the chain guide in a manner such that, at any operational or slope conditions, a pulling apart or pushing together of the chain links is prevented and, consequently, a permanently satisfactory engagement true to pitch between the sprocket wheel and the round-link chain is ensured even in cases where the scraper chain conveyor is run through anticlines, synclines, or curves or used in a moderate or very steep formation.

In accordance with the invention, and regardless of the given operational or slope conditions, a pulling apart or pushing together of the chain links is prevented or at least reduced to such an extent that a satisfactory chain pitch is continually maintained, not only over the length of the hollowed sectional parts, but particularly also in the transition zones between the individual trough sections, despite the fact that the round-link chain remains unchanged and is still a continuous chain.

The clearance of motion of the chain strand sections associated with the individual trough sections corresponds to the maximum angular misalignment of adjacent trough sections and, thereby, of the chain strand sections in the horizontal and vertical planes. Inversely, due to the subdivision of the round-link chain into chain strand sections and their fixing to the associated trough sections, it is also ensured that the trough sections cannot be arbitrarily pushed together and are constantly kept at a well-defined distance in their junction zones.

There are still other features which are substantial for the invention. In one development of particular importance, crossbolts are passed through the chain strand sections, which engage corresponding oblong slots provided in the hollowed sectional parts, where they have a clearance of motion corresponding to that provided for the chain strand sections. The oblong slots are provided in the side walls of the hollowed sections and also extend in the longitudinal direction of the sections or of the chain strand. Each chain strand section is advantageously equipped with at least one, and preferably two, crossbolts of its own. Two crossbolts will be provided, for reasons of security, especially in cases where the inventive scraper chain conveyor is to be used in semi-steep or steep slopes.

The invention further provides that the chain strand sections are connected to the hollowed sectional parts in such a position that the horizontal chain links each extend above a cleanout recess provided in the bottom portion of the associated hollowed section. The horizontal chain links are thus fixed above the cleanout recesses. This enables the teeth of the sprocket wheel or wheels engaging into the horizontal chain links to effectively and continually contribute to the cleaning of the hollowed sectional parts by pushing coal fines or similar dirt deposited therein through the horizontal chain links into the cleanout recesses and then out of the hollowed sectional parts.

In accordance with the invention, the pitch of the chain strand sections is such that with a symmetrically positioned strand section, the respective last chain links on both sides, at the ends of the trough sections, project by one-half of the clearance of motion of the chain strand sections. The articulation needed for rendering the strand horizontally and vertically flexible in the junction areas is thereby obtained. The predetermined clearance of motion of the crossbolts in their oblong slots and thus of the chain strand sections in the hollowed sectional parts preferably amounts to 10 mm to 15 mm. Such a clearance of motion is sufficient to cover horizontal and vertical breaks in the alignment of the trough sections.

The primary advantage of the invention is that a scraper chain conveyor, particularly with a single chain, is obtained in which, while maintaining the horizontal and vertical flexibility of the driving chain which is designed as a round-link chain, a continually satisfactory engagement, true to pitch, between the sprocket wheel and the driving chain is obtained, even under conditions where the scraper chain conveyor must follow anticlines, synclines, curves, or semisteep or steep slopes. Under all of these conditions, due to the subdivision of the continuous round-link chain into chain strand sections extending over the length of the respective trough section or hollowed sectional part and having a predetermined clearance of motion, a pulling apart or pushing together of the chain links is prevented or considerably reduced so that, as a result, a uniform distribution of all of the interengaging chain links over the entire length of guide structure for the cutter pulling chain is ensured even under most varying operating and slope conditions. This is obtained with relatively simple means which are reliable in operation.

Accordingly, it is an object of the invention to provide a scraper chain conveyor assembly, which comprises a plurality of trough sections arranged in end-to-end relationship and a bracket side section extending alongside each trough section which includes a hollowed sectional part and further including a mining machine embracing the hollowed sectional part and having a sprocket wheel and with a round-link chain extending through the hollowed sectional part and having respective crossing links held by the sectional part in a crossing orientation and with an elongated slot defined in the sectional part overlying the similarly aligned ones of the links so that the sprocket wheel of the mining machine may engage with the aligned links through the slot and wherein the chain is divided without any separation of the chain links from each other into chain sections equal in length to the length of the trough sections and they are associated with the trough sections in a manner such as to leave a predetermined clearance of motion for the chain strand in the longitudinal direction thereof.

A further object of the invention is to provide a scraper chain conveyor assembly which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
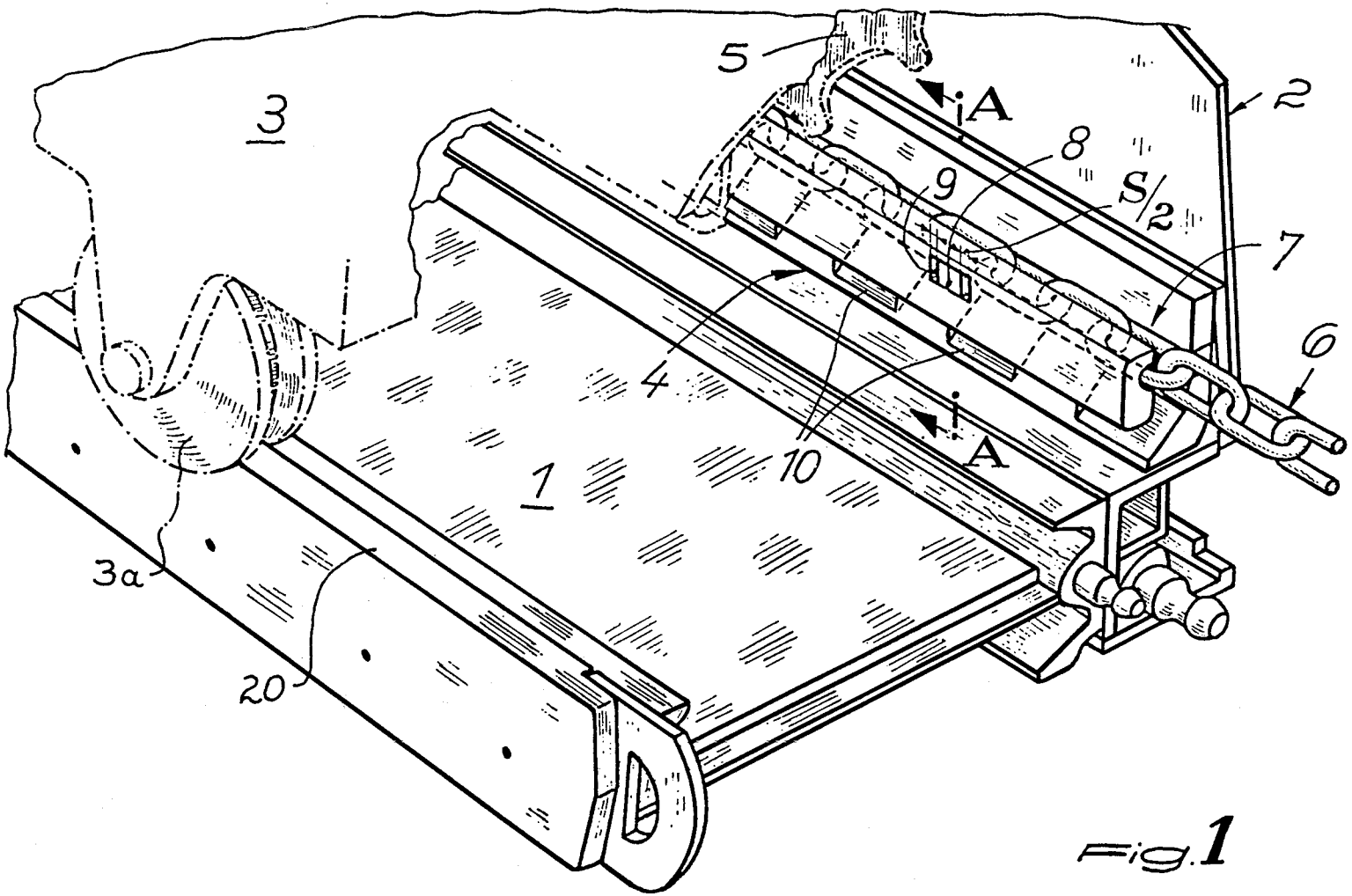
FIG. 1 is a partial front top perspective view of a scraper chain conveyor assembly constructed in accordance with the present invention.
Figure 2:
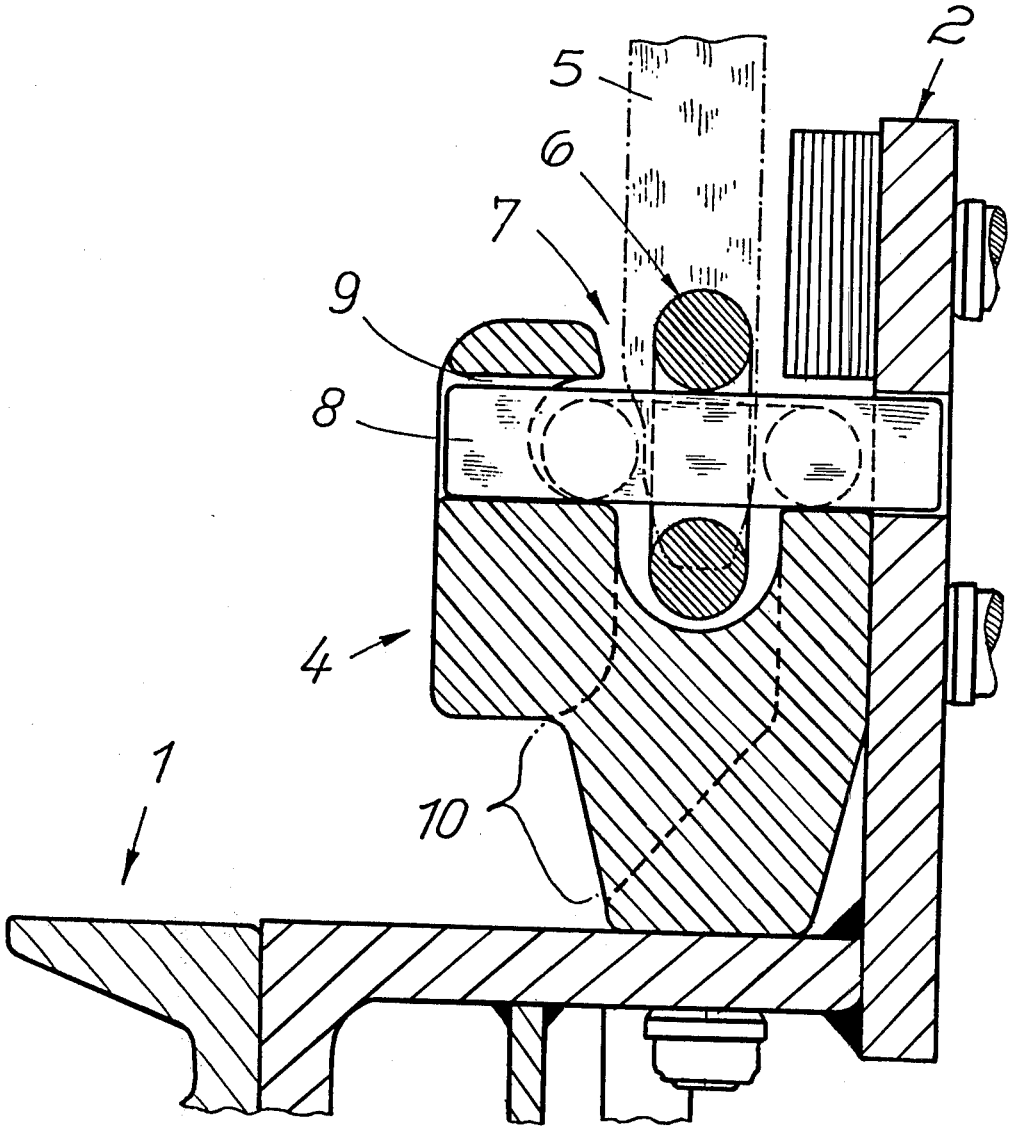
FIG. 2 is a section taken along the line A—A of FIG. 1.
Figure 3:
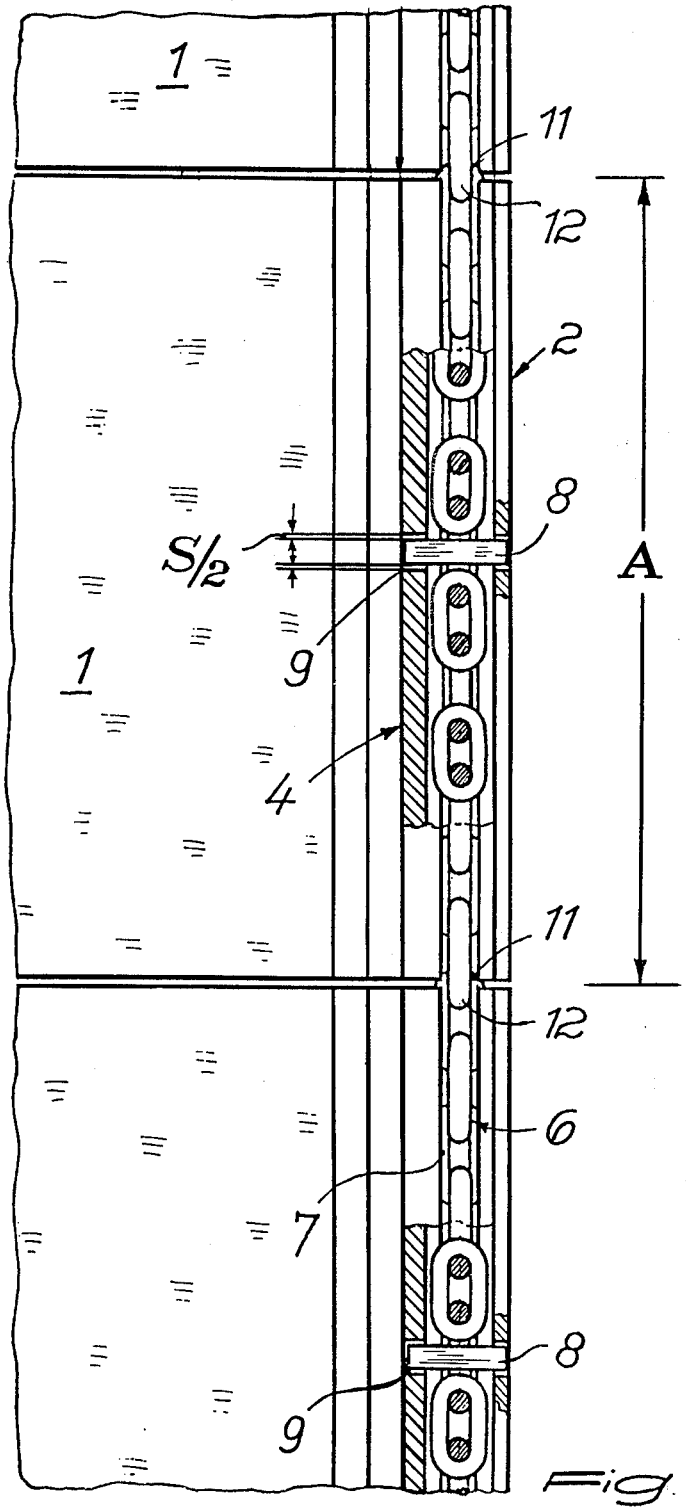
FIG. 3 is a partial top plan and partial sectional view of the assembly shown in FIG. 1.

Referring to the drawings in particular, the invention embodied therein, comprises, a scraper chain conveyor assembly, which comprises a plurality of trough sections, generally designated 1, arranged in end-to-end relationship and a bracket side section 2 extending alongside each trough section and including a hollowed sectional part 4. A mining machine 3, as shown in FIG. 1, embraces the hollowed sectional part 4 and has a sprocket wheel 5 which is adapted to engage with a round link chain which runs through the hollowed sectional part 4.

The drawings show a scraper chain conveyor with a single chain comprising, substantially, trough sections 1, a bracket-shaped side section 2, and a mining machine 3, in particular, a cutter. The side sections 2 comprise hollowed sectional parts 4 which are partly engaged by the mining machine 3 to guide the same. The mining machine 3 comprises at least one sprocket wheel 5 engaging a round-link chain 6 which extends in the direction of the working face and serves as a drive chain. Round-link chain 6 is guided in hollowed sectional parts 4.

While the bracket-shaped side sections 2 and the trough sections 1 are of equal length, the hollowed sectional parts 4 may be subdivided or made discontinuous over the length of the trough sections 1, but at both extremities, their ends are flush with those of the side sections 2 and trough sections 1. Hollowed sectional parts 4 are provided, in their upper portion, with an engagement slot 7 for sprocket wheel 5, which slot extends through the whole part 4 in the longitudinal direction thereof. The round-link chain 6 continuously extending over the entire length of all of the hollowed sectional parts 4 is subdivided, without a separation of links, into chain strand sections A which correspond to the length of trough sections 1. These chain strand sections A are associated with their respective trough sections 1 and have a predetermined clearance of motion S in the longitudinal direction of the strand.

Crossbolts 8 are inserted in chain strand sections A. The crossbolts 8 engage corresponding oblong slots 9 provided in hollowed sectional parts 4 or the side walls thereof, andd they have a clearance of motion S corresponding to that predetermined for chain strand sections A. Each chain strand section A is equipped with at least one, and preferably two, crossbolts 8. Chain strand sections A are connected to the associated hollowed sectional parts 4 in a manner such that every horizontal link of the chain is positioned above a cleanout recess 10 provided in the bottom portion of hollowed sectional part 4.

The pitch chosen for chain strand sections A is such that with a symmetrically extending chain strand section A, the respective last links 11 and 12 on both ends of the trough section project beyond these ends by one-half of the clearance of motion S of chain strand sections A. The predetermined clearance of motion S of crossbolts 8 in the oblong slots and thus of chain strand sections A in hollowed sectional parts 4 amounts to 10 mm to 15 mm, in accordance with the horizontal clearance of motion of the trough sections during the shifting operation.

The mining machine 3 is positioned over the trough section 1 and the bracket side section 2 and it includes at least one guide wheel 3*a* which is engaged on a side member 20 which supports the trough section 1. The mining machine 3 also includes a sprocket 5 in engagement with the round-link chain 6 and the sprocket is rotated to move the mining machine 3 along the length of the chain.

While a specific embodiment of the invention has been shown and described in detail to illustrate the application of the principles of the invention, it will be understood that the invention may be embodied otherwise without departing from such principles.

What is claimed is:

1. A scraper chain conveyor assembly, comprising a plurality of trough sections arranged in end-to-end relationship, a bracket side section extending alongside each trough section and including a hollowed sectional part, a mining machine embracing said sectional part and having a sprocket wheel, a round link chain extending through the hollow sectional part and having respective crossing links held by said sectional part in a crossing orientation, said sectional part having an elongated slot overlying said links in said crossing orientation, said sprocket wheel being engaged with said links in said crossing orientation through said slot, said chain being subdivided without any separation of said chain links from each other into chain sections equal in length to the length of said trough section, said chain strand sections being associated with said trough sections in a manner such as to leave a predetermined clearance of motion for the chain strand in a longitudinal direction thereof, said hollowed sectional part including at least one transverse slot extending therethrough transverse to the hollowed portion and a crossbolt extending through said slot and through a chain link having a clearance of motion in the slot which equals the clearance of motion of said chain strand section.

2. A scraper chain conveyor assembly, comprising a plurality of trough sections arranged in end-to-end relationship, a bracket side section extending alongside each trough section and including a hollowed sectional part, a mining machine embracing said sectional part and having a sprocket wheel, a round link chain extending through the hollow sectional part and having respective crossing links held by said sectional part in a crossing orientation, said sectional part having an elongated slot overlying said links in said crossing orientation, said sprocket wheel being engaged with said links in said crossing orientation through said slot, said chain being subdivided without any separation of said chain links from each other into chain sections equal in length to the length of said trough section, said chain strand sections being associated with said trough sections in a manner such as to leave a predetermined clearance of motion for the chain strand in a longitudinal direction thereof, said hollowed sectional part including at least one transverse slot extending therethrough transverse to the hollowed portion and a crossbolt extending through said slot and through a chain link having a clearance of motion in the slot which equals the clearance of motion of said chain strand section, the predetermined clearance of motion of said crossbolts and, thereby, of the chain strand sections amounting to from 10 mm to 15 mm.

3. A scraper chain conveyor assembly, as claimed in claim 1, wherein each of said chain strand sections has a plurality of transverse slots with a corresponding number of crossbolts therein.

4. A scraper chain conveyor assembly, as claimed in claim 1, wherein said hollowed sectional part includes a longitudinally extending hollowed portion through which the chain link extends and including a cleanout passage extending downwardly from said hollowed section and opening outwardly at the bottom of said hollowed section.

5. A scraper chain conveyor assembly, as claimed in claim 1, wherein the chain pitch chosen for the chain strand sections is such that with symmetrically positioned chain strand sections, the respective last chain links on both sides at the ends of the trough sections project by one-half of the clearance of motion of the chain strand sections.

* * * * *